US006157141A

United States Patent [19]

Lapatovich et al.

[11] Patent Number: 6,157,141

[45] Date of Patent: Dec. 5, 2000

[54] BLUE LIGHT ELECTRODELESS HIGH INTENSITY DISCHARGE LAMP SYSTEM

[75] Inventors: Walter P. Lapatovich, Boxford; Joanne M. Browne, Malden; Fred L. Palmer, Danvers; A. Bowman Budinger, Westford; Nancy H. Chen, Salem, all of Mass.

[73] Assignee: Osram Sylvania Inc., Danvers, Mass.

[21] Appl. No.: 09/163,532

[22] Filed: Sep. 30, 1998

Related U.S. Application Data

[60] Provisional application No. 60/084,362, May 5, 1998.

[51] Int. Cl.[7] ..... H05B 41/16

[52] U.S. Cl. ..... 315/248; 315/39; 313/317; 313/634; 313/637

[58] Field of Search ..... 315/39, 248; 313/113, 313/153, 160, 161, 317, 524, 567, 634, 637

[56] References Cited

U.S. PATENT DOCUMENTS

| | | | |
|---|---|---|---|
| 3,711,700 | 1/1973 | Westlund | 240/41.15 |
| 3,786,308 | 1/1974 | Browner | 315/248 |
| 3,867,664 | 2/1975 | Chalmers et al. | 313/229 |
| 3,906,274 | 9/1975 | Silver | 313/228 |
| 3,947,714 | 3/1976 | Rehder et al. | 313/225 |
| 4,021,696 | 5/1977 | Taxil et al. | 313/229 |
| 4,498,029 | 2/1985 | Yoshizawa | 315/39 |
| 4,929,869 | 5/1990 | Yonezawa et al. | 313/639 |
| 5,070,277 | 12/1991 | Lapatovich | 315/248 |
| 5,864,210 | 1/1999 | Hochi et al. | 313/637 |

FOREIGN PATENT DOCUMENTS

| | | | |
|---|---|---|---|
| 0 063 441 A1 | 10/1982 | European Pat. Off. | H01J 65/04 |
| 0 762 476 A1 | 3/1997 | European Pat. Off. | H01J 61/12 |
| 0 883 160 A1 | 12/1998 | European Pat. Off. | H01J 61/12 |
| WO 97/48997 | 12/1997 | WIPO | G02B 6/44 |

*Primary Examiner*—Don Wong
*Assistant Examiner*—Thuy Vinh Tran
*Attorney, Agent, or Firm*—William E. Meyer

[57] ABSTRACT

An electrodeless high intensity discharge lamp with a lamp fill material including gallium iodide has been found to be more efficient in generating light in general, and more efficient in generating blue light. The very small size of the lamp, in combination with the high intensity in a relatively narrow blue spectral range make the lamp particularly useful in supplying blue light to a fiber optic. The relative efficiency of the lamp increases its value. In combination, the lamp provides a useful, efficient source of blue light as an input source for optical fiber, and other systems for medical and other processes using blue light as a process element.

15 Claims, 11 Drawing Sheets

| LAMP | DATE | SIZE | | (mg) | | (mg) | (mg) | | | (lorr) |
|---|---|---|---|---|---|---|---|---|---|---|
| 98014 | 3/13/98 | 2X4X6 mm | Gal3 | 0.28 | | | Hg | 0.39 | Ar | 5 |
| 98031 | 4/6/98 | 2X4X6 mm | Gal3 | 0.24 | | | Hg | 0.39 | Ar | 5 |
| 98032 | 4/6/98 | 2X4X6 mm | Gal3 | 0.193 | | | Hg | 0.399 | Ar | 5 |
| 98035 | 4/13/98 | 2X4X6 mm | Gal3 | 0.291 | | | Hg | 0.412 | Ar | 5 |
| 98036 | 4/13/98 | 2X4X6 mm | Gal3 | 0.221 | | | Hg | 0.408 | Ar | 5 |
| 98037 | 4/13/98 | 2X4X6 mm | Gal3 | 0.282 | | | Hg | 0.407 | Ar | 5 |
| 98038 | 4/13/98 | 2X4X6 mm | Gal3 | 0.26 | | | Hg | 0.39 | Ar | 5 |
| 98056 | 5/28/98 | 2X4X6 mm | All3 | 0.09 | | | Hg | 0.42 | Ar | 5 |
| 98057 | 5/28/98 | 2X4X6 mm | All3 | 0.08 | | | Hg | 0.385 | Ar | 5 |
| 98094 | 8/27/98 | 2X4X6 mm | Fel2 | 0.04 | | | Hg | 0.415 | Ar | 10 |
| 98095 | 8/27/98 | 2X4X6 mm | Fel2 | 0.08 | | | Hg | 0.406 | Ar | 10 |
| 98096 | 8/27/98 | 2X4X6 mm | Fel2 | 0.12 | | | Hg | 0.393 | Ar | 10 |
| 98097 | 8/27/98 | 2X4X6 mm | Fel2 | 0.08 | | | Hg | 0.395 | Ar | 10 |
| 98104 | 9/9/98 | 2X4X6 mm | Fel2 | 0.1 | | | Hg | 0.406 | Ar | 10 |
| 98105 | 9/9/98 | 2X4X6 mm | Fel2 | 0.16 | | | Hg | 0.402 | Ar | 10 |
| 98106 | 9/9/98 | 2X4X6 mm | Fel2 | 0.18 | | | Hg | 0.414 | Ar | 10 |

FIG. 11

BLUE LIGHT ELECTRODELESS HIGH INTENSITY DISCHARGE LAMP SYSTEM

The invention concerns electric lamps and in particular high intensity discharge electric lamps. More particularly, the invention concerns an electrodeless high intensity discharge lamp providing blue light. The Applicants hereby claim the benefit of their provisional application, Ser. No. 60/084,362 filed May 5, 1998 for Blue Light Electrodeless High Intensity Discharge Lamp System.

BACKGROUND

High intensity discharge lamps with a high UV or "blue" output are often used for medical purposes. One example is a short arc mercury lamp that produces a rich spectrum in the ultraviolet (UV) near 365 nanometers. Other examples of UV discharge light sources are suntan lamps which are basically fluorescent lamps with near UV emitting phosphors to produce UV A or UV B. Mercury lamps without phosphor and quartz envelopes are frequently used to generate high energy UV for disinfectant purposes. High pressure xenon arc lamps, for example Cermax lamps, are used for medical illumination.

Lamps are also used to cure polymers used in dental reconstructive procedures where the UV or blue light is needed to crosslink the molecules to form a solid material. The UV curing application is used with the polymeric lamp filler materials to repair dental caries. Occasionally, these chemical systems require concentrated light in a specific spectral band and other light is wasted. Often it is important to shield the patient from unnecessary light, since the fluxes can be high. Such light delivery systems can be inefficient, since many watts of input electric power are used to produce only a few watts of useable blue light.

Methods of spectral tailoring the blue light from a source have included phosphor emission which is limited to a spatially extended source. Other methods include filtering the broadband emission, such as from a more compact halogen incandescent lamp to achieve the desired spectral pass band. Another method is to use a laser which can provide light in the desired spectral region such as an argon ion laser with atomic emission lines at 457 and 458 nanometers. Blue lasers are expensive to operate and usually require a skilled operator. The laser systems pose the additional problem of shielding the patient from coherent light and must follow strict exposure guidelines. Still, another alternative is a blue emitting solid state laser or LED. Currently, blue laser or LED devices have low power or are unreliable, having operating lifetimes of about 100 hours.

Often it is necessary to have light within a specific spectral band and any out-of-band light must be rejected or converted into heat. Electrodeless high intensity discharge (EHID) lamps can offer an advantage in this area since EHID lamp fills can be tailored to emit in the pass bands of interest with minimal radiation outside the band (waste). Consequently, there is minimal conversion of excess light into heat. There is then a general need for an intense, efficient blue light.

BRIEF DESCRIPTION OF THE DRAWINGS

FIG. 11 shows a table lamps sizes and fills tested.

DESCRIPTION OF THE INVENTION

Figure 1:
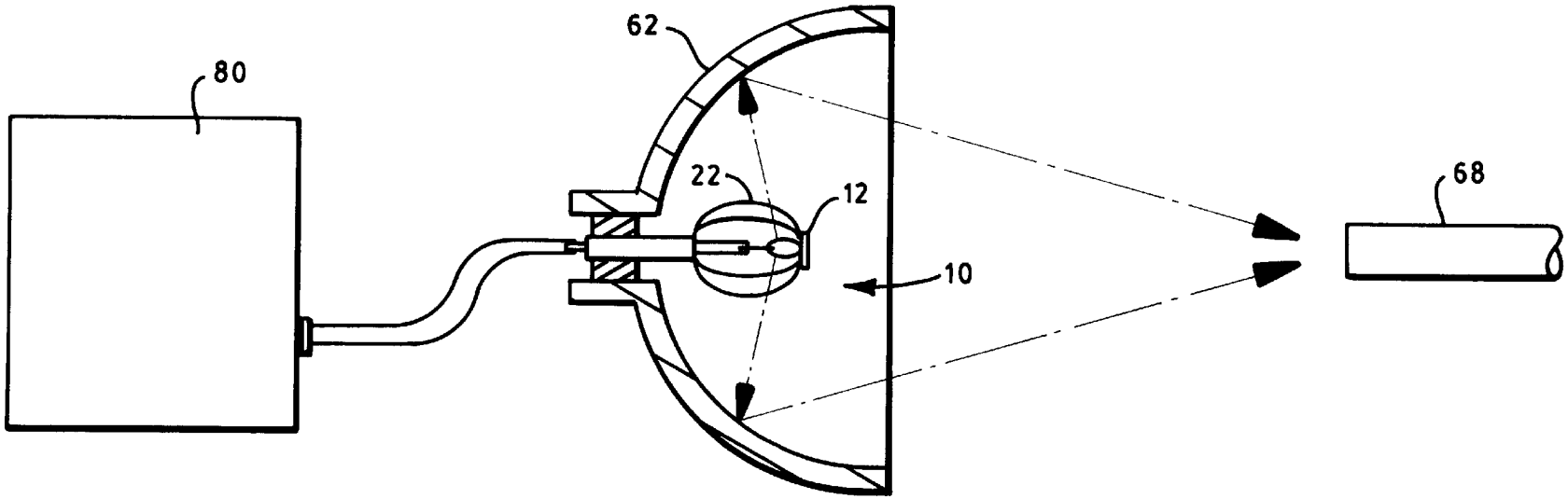
FIG. 1 shows a schematic view of a preferred embodiment of an EHID lamp system.

FIG. 1 shows a schematic view of a preferred embodiment of an EHID lamp assembly 10 powered by a power supply 80. The lamp assembly 10 is positioned in a reflector 62 to direct generated blue light to a light channeling device 68.

Figure 2:
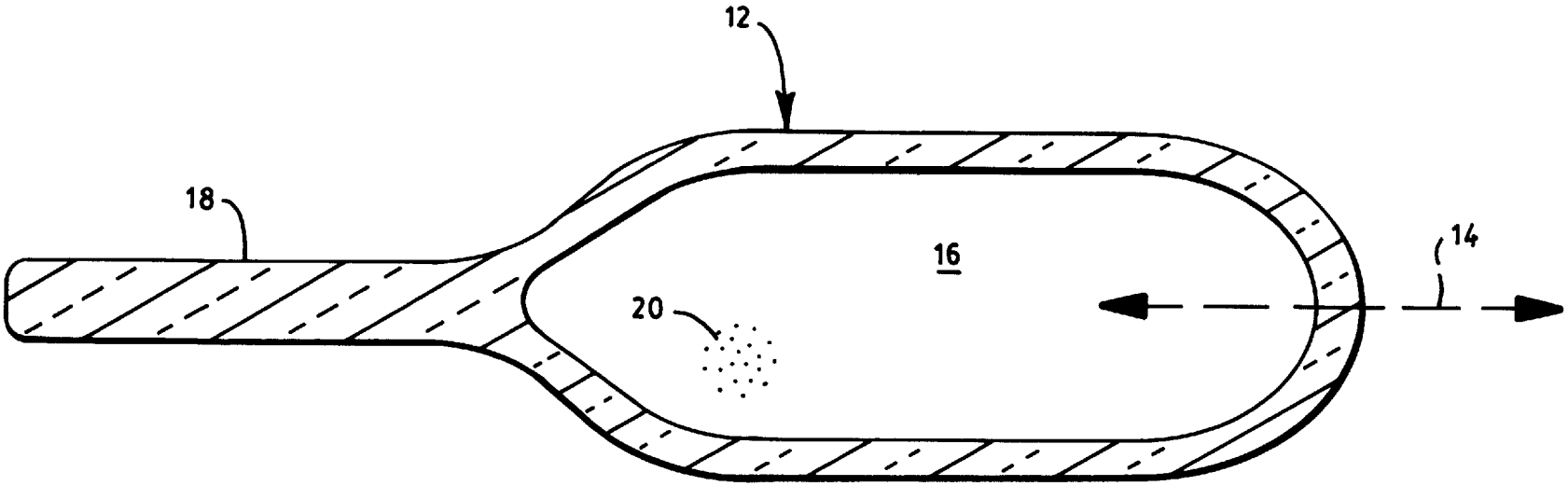
FIG. 2 shows a cross sectional view of a preferred embodiment of an EHID lamp envelope.

FIG. 2 shows the preferred embodiment of an EHID lamp capsule. The EHID lamp capsule may be made with a light transmissive material in the form of a closed tubular envelope 12, thereby defining a lamp axis 14, and an enclosed volume 16. The preferred envelope 12 comprises is an approximately cylindrical vitreous silica (quartz) tube sealed at each end, and having an axially extending rod portion 18 coupled to one end. Very small (0.005 cubic centimeters) to rather large (1.0 cubic centimeter) envelope may be made. A practical size made by the Applicants had a volume of about 0.017 cubic centimeters. Positioned in the enclosed volume 16 is a lamp fill 20.

The lamp fill 20 is a material combination excitable by a selected range of microwave power to emit blue light. The preferred lamp fill 20 includes metal halide salts and may include mercury, and a low pressure (cold) lamp fill buffer gas pressure. In the preferred embodiment, the lamp fill 20 includes no alkali atomic species (Group IA of the Periodic Table). The alkali species have been found to be unnecessary for arc stability when the present fill formulations are used. An inert buffer gas is used, and the preferred buffer gas is argon.

The preferred lamp fill 20, is formulated to produce an intense blue emission, and preferably includes gallium halides, indium halides, aluminum halides, or iron halides. Gallium iodide is a particularly preferred fill component. The blue lamp fills may be used alone, or may be used with a small amount of mercury to produce a dense plasma upon excitation with microwave power. The strong atomic emissions from elemental gallium at 417.2 and 403.2 nanometers (blue) blend with the mercuric iodide emission at about 445 nanometers to produce a substantially blue light. In a similar fashion, indium, which also has strong blue atomic emissions, for example at 410.1 and 450.1 nanometers (blue), may also be included to further enhance the blue output. Fill concentrations from about 4 milligrams to about 25 milligrams per cubic centimeter have been tested, and experience with this type of lamps indicates that lower and higher concentrations can be achieved with some tuning of the power supply and applicator. Concentrations from 1 to 50 milligrams per cubic centimeter should be sustainable without undue power requirements.

It is a feature of the present invention that no alkali atomic species is needed to stabilize the plasma discharge. The gallium and indium atoms have resonance levels close to one half of their ionization potentials. The gallium and indium atoms have been found to be sufficiently ionized in the plasma, that a lower ionization potential material, such as sodium, is therefore not necessary to sustain the discharge. The lower ionizing alkalis can be eliminated from the plasma with the result that the spectral (red) losses due to the alkali species are eliminated. Modifications to the lamp fill amounts, and combinations of indium, aluminum and gallium can be used to cover the blue band more completely through self-reversal, collisional broadening, and spectral combination. While mixtures of the separate iodide fill components is possible, for example for improved arc control, because the blue spectral outputs are similar or overlapping, the possible chemical interferences between the components increases with additional components, the combinations are felt to be less preferred embodiments.

Figure 3:
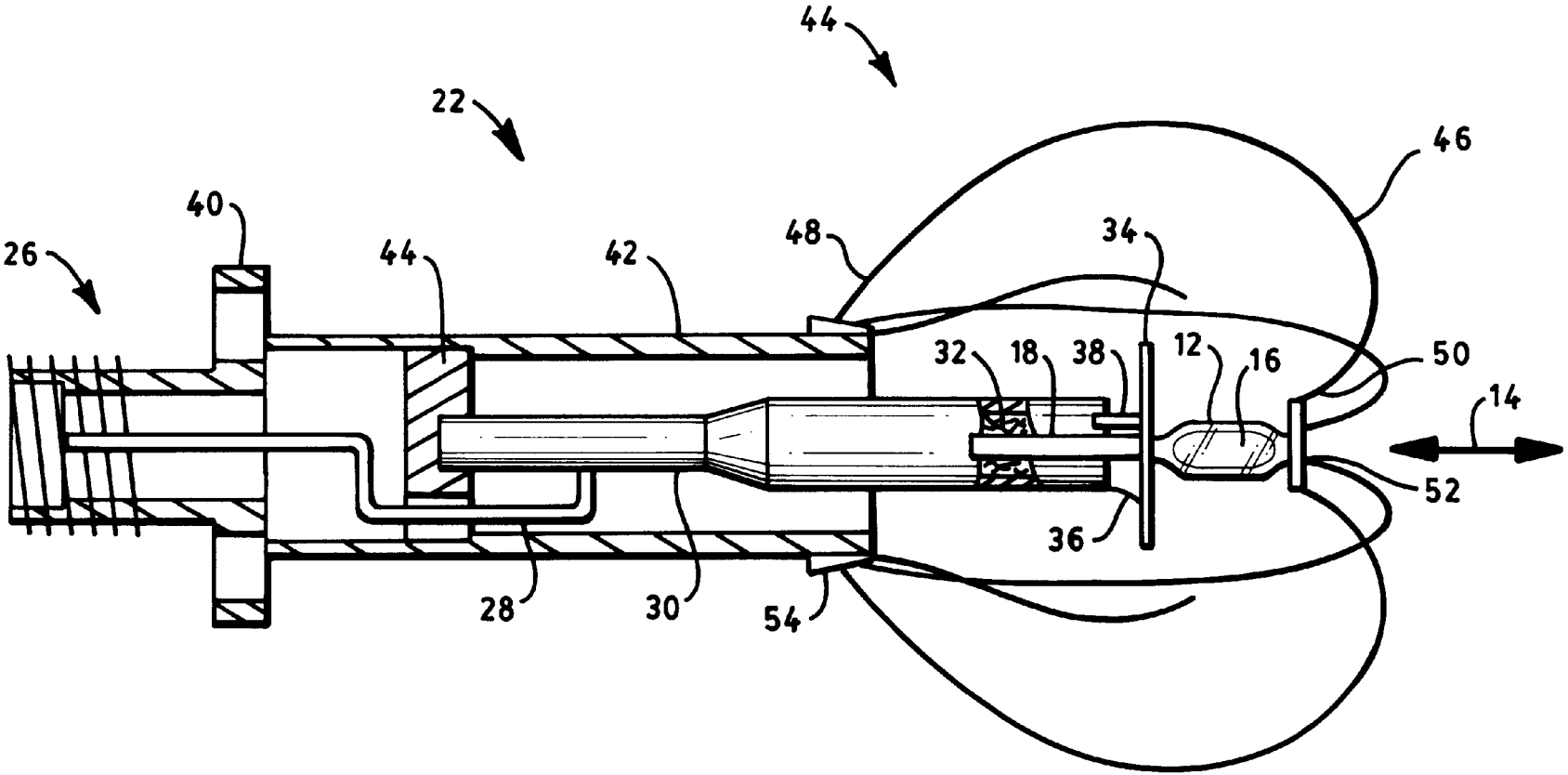
FIG. 3 shows schematic view of a preferred embodiment of an EHID power applicator.

FIG. 3 shows a schematic side view of the preferred embodiment of the lamp envelope 12 positioned in a power applicator 22. The power applicator 22 is designed to receive a microwave power input, and direct the microwave power to the lamp capsule to excite light emission. The preferred power applicator 22 consists of a coaxial connector 26, with a feed wire 28 and an outer shield 40. The feed wire 28 is connected to a center conductor 30 that has a hollow distal end. The envelope 12 is partially positioned in the distal end of the center conductor 30 with the rod portion 18 supported axially in the center conductor 30, for example with a cement 32. The enclosed volume 16 is positioned outside of the center conductor 30 axially offset from the distal end of center connector 30. Extending from an end of the center conductor 30 is a guard ring 34 encircling the capsule 12 and the rod portion 18. The guard ring 34 is coupled to the distal end of the center conductor 30 by thin tabs 36. The guard ring 34 has the general form of a ring, and extends around the rod portion 18.

Coupled to the outer shield 40 is an outer tube 42. Outer tube 42 is hollow, and it axially surrounds the center conductor 30, and extends partially over the length of the center conductor 30, so that a portion of the center conductor 30, including the distal end of the center conductor 30 extends axially beyond the distal end of the outer tube 42. The center conductor 30 is centrally held, offset from and, insulated from the outer tube 42 by insulator 44. The remaining volume between the center conductor 30 and the outer tube 42 may be filled with an insulating material that is usually air. However, a dielectric such as polytetrafloraethylene (teflon) may be used.

The center conductor 30 and the outer tube 42, then form a coaxial geometry which guides electromagnetic fields into the space at the end of the center conductor 30 and thereby couples the microwave power into the lamp capsule 12 when placed in close proximity thereto. The power applicator 22 may also include impedance matching structures. For example, a grounded center conductor 30 impedance matching technique may be used, wherein the center conductor 30 is approximately one quarter wavelength long at the microwave frequency of operation may be used.

Extending from an end of the outer tube 42 is a wire cage structure 44. To form the cage 44, two or more wires 46 with input ends 48 are extended from the distal end of the outer tube 42. The wires 46 extend symmetrically around and offset from the center conductor 30, and similarly extend symmetrically around and offset from the lamp capsule 12 and enclosed the volume 16. The wires 46 then extend beside the envelope 12, but are offset from the envelope 12 by a fraction of one wave length of the microwave power selected to be applied to the lamp. The wires 46 extend along at least the length of the enclosed volume 16, and then curve inwards towards the lamp axis 14 where output ends 50 of the wires 46 are offset from the distal most portion of the enclosed volume 16. A plurality of such wires 46 may be extended symmetrically around the enclosed volume 16, thereby defining a cage 44 around the envelope 12 and the enclosed volume 16.

The number and size of the wires 46 forming cage 44 may vary from one embodiment to another, but a typical cage 44 consists of 3 to 12 wires, each wire 46 being about 0.5 millimeters in diameter. The outer conductor 40, the outer tube 42 and the cage 44 formed by the lengths and diameters of wires 46 can be altered or tuned to optimize power coupling to the particular lamp envelope 12 and lamp fill 22. In the preferred embodiment, additional small bendable metal tabs 37, 38 are placed on the distal end of the outer conductor 40, outer tube 42 or on the cage 44 or wires 46 to adjust the optimum microwave operating frequency.

It is easier to form the cage 44 where each wire 46 is coplanar with the lamp axis 14, however, it is also possible to turn the wires 46 symmetrically positioned around the axis 14 to have a spiraling aspect. It is important that the wires 46, for the most part, are arranged symmetrically around the lamp axis 14 to form a uniform field around the enclosed volume 16. Using a large number of wires 46 to form the cage 44, results in a more uniform field, and reduces stray microwave radiation; however, the greater the number of wires 46, the greater the light loss due to absorption by the interposed wires 46, and the greater the glare due to reflections from the wires 46, or the greater the disturbance of a beam pattern due to the shadows of wires 46. The goal is to then balance the need for a uniform arc with the need for an unintruded view of the arc. The Applicants prefer six wires 46 symmetrically positioned around the lamp axis 14. For mechanical support and durability, it is convenient to link the output or free ends 50 of the wires 46. The wires 46 may be connected by a ring 52 that is coaxial with the lamp axis 14, and offset form the distal end of the lamp capsule 12. The wires 46 then conduct and guide the supplied microwave power close to the lamp envelope 12 to excite the fill material 20. The current return wires 46 also form an effective electromagnetic shield that prevents microwave radiation from escaping from the distal end region of the power applicator 22.

In one embodiment, power applicator 22 was formed with a cage 44 consisting of six wires 46 distributed approximately 60 degrees around the axis 14. The wires 46 were each attached at their respective input ends 48 to the exterior end surface of the outer tuber 42, and while the respective output ends 50 of the wires 46 terminated in a ring 52 disposed concentrically about the distal end of the cylindrical lamp envelope 12. The cage 44 structure may be formed from individual wires 46 that are pre-shaped and then brazed or welded in place to holding structures at each wire end. The brazed or welded couplings are sufficient to sustain the high temperature of lamp operation.

Figure 4:
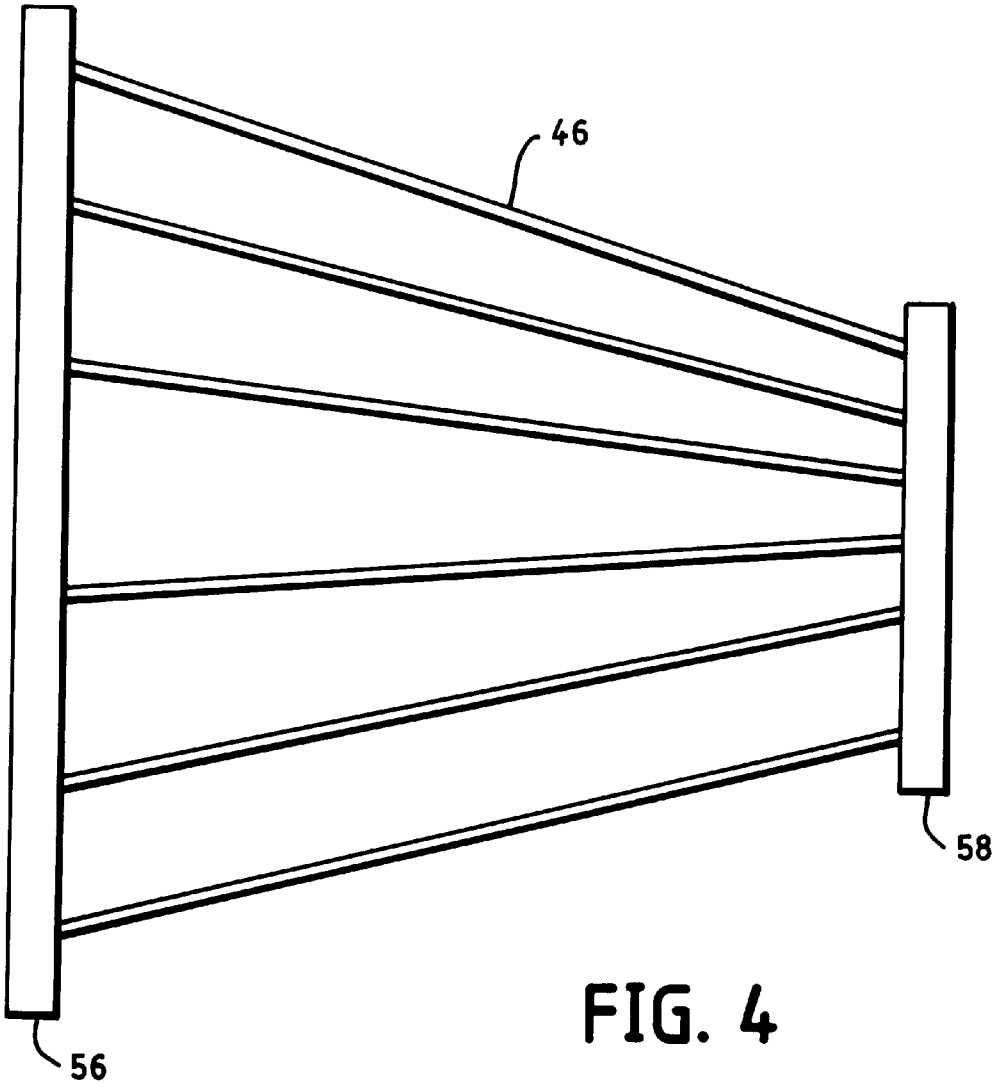
FIG. 4 shows a top view of a metal work piece prior to forming into a wire cage.

FIG. 4 shows a top view of a metal work piece prior to forming into a wire cage 44. A sheet of thin metal may be stamped or otherwise cut, as in FIG. 4, with multiple metal strips (e.g. six wires) extending between two transverse end supports, such as axially transverse ribbons 56, 58. The end supports 56, 58 (ribbons) may then be rolled and welded or brazed end to end forming two support rings with parallel strips (e.g. six wires 46) extending between newly formed support rings. One metal ring 56, the larger ring, may then be brazed to the distal end of the outer tube 42. The metal strips or wires 46 may then be bent radially away from the axis 14 between the support rings 56, 58 to expand the volume caged by the wires 46. The smaller ring 58 may be positioned axially offset from the distal end of the envelope 12. The cut or stamped coaxial cage 44 is smaller, sturdier and more manufacturable than earlier termination fixtures.

The impedance of the lamp envelope 12 and the power applicator 22 may not perfectly match that of the power source, so it is convenient to form the power applicator 22 with adjustable tabs 37, 38 that can be tuned to adjust the power applicator's 22 impedance. The tabs 37, 38 may have a similar wire form, as the wires 46, and may be co-formed with the single work piece. The preferred tabs thin, flat metal pieces that have attached ends fixed to the distal end of the outer tube 40, and free ends that extend inside the region of the wire cage 44, towards the lamp envelope 12 to end roughly in a plane transverse to the nearer end of the lamp envelope 12. The impedance of power applicator 22 may be tuned by adjusting the position or size of tuning tabs 37, 38 attached to outer tube 40 to thereby minimize reflected microwave power, and thereby ensure good power delivery to the lamp envelope 12 and the enclosed fill 20. Since, the tabs 37, 38 are unattached, the preferred form of the tabs 37, 38 is to be sufficiently wide and thick to be relatively rigid, once they are bent into a preferred position. By bending the free ends of the tabs 37, 38 towards or away from the lamp envelope 12, the impedance of the power applicator 22 can be adjusted. In one embodiment the tabs 37, 38 were formed from shim stock with a thickness of about 0.25 mm (0.01 inch), a width of about 0.76 mm (0.03 inch) and about 12.7 mm long (0.5 inch).

The small size of the power applicator 22 with its cylindrical (axial) symmetry permits insertion of the envelope 12 and the power applicator 22 as an assembly into a number of optical collectors (reflectors) through existing or minimally modified holes. The preferred embodiment of the power applicator 22 has a maximal transverse cross section which is small enough to fit into existing holes in optical collectors (reflectors) to be used in existing reflectors without modification. This generally requires fitting the lamp envelope 12 and power applicator 22 assembly through a circular opening with a diameter less than one inch, and this can be achieved with the small size lamp envelope 12 and applicator 22. The preferred power applicator 22 otherwise has the coaxial geometry which is the subject of a copending application, Provisional Ser. No. 60/076631, filed Mar. 3, 1998 which is hereby incorporated by reference.

Figure 5:
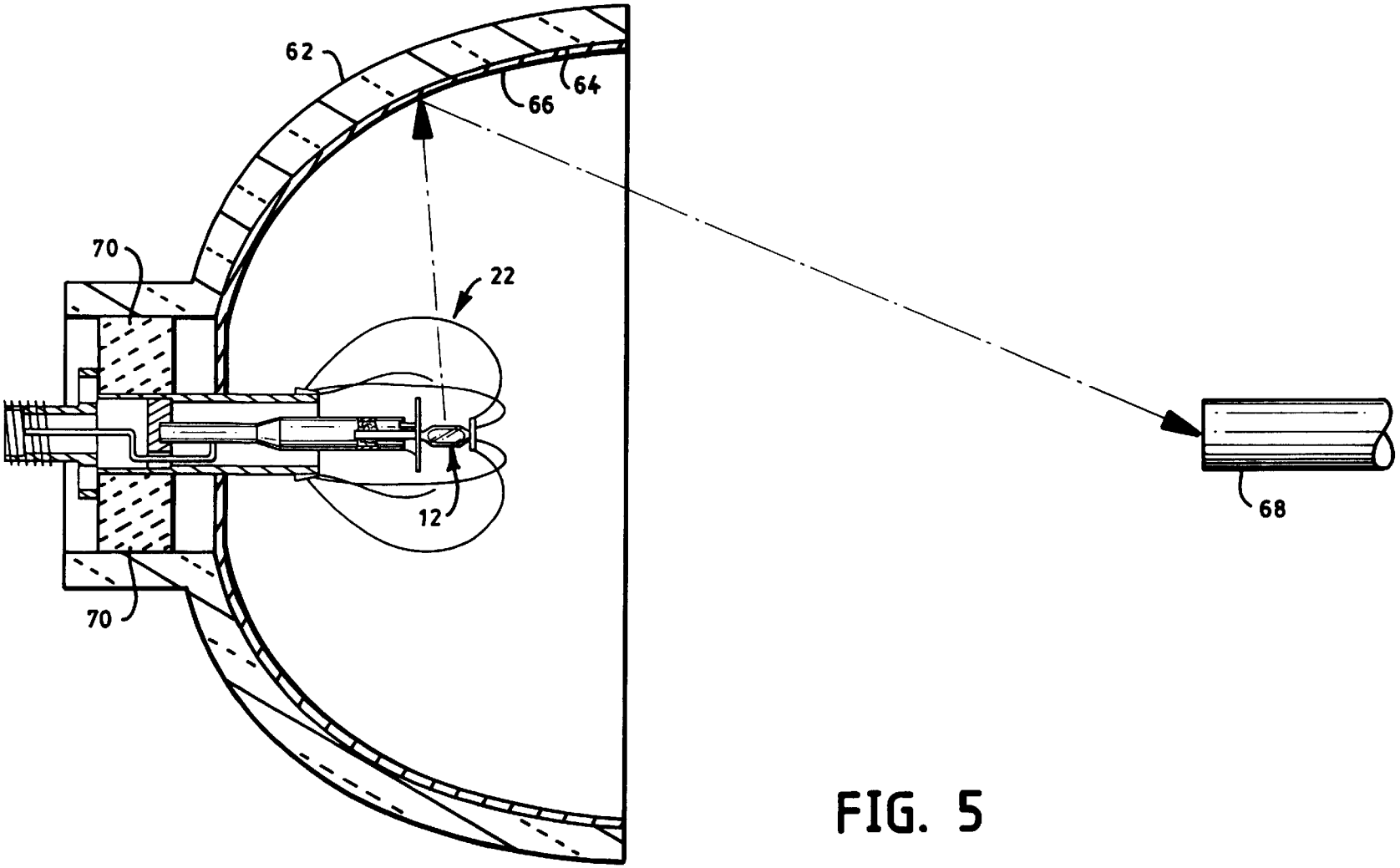
FIG. 5 shows a power applicator positioned in a reflector shown in cross section.

FIG. 5 shows an EHID lamp with a gallium lamp fill mounted inside of a dichroic coated glass reflector show in cross section. The preferred lamp envelope 12 and power applicator 22 assembly is positioned in a reflector 62 having surface 64 reflecting at least portions of the chosen blue output light, and transmitting at least some, and preferably all of the remaining portions of the output light. The small, compact EHID lamp which can be mated with an optical collector, which may be a glass reflector with a dielectric coating 66 (multilayer stack) to enhance the blue portion of the spectrum. The lamp may also be used with metal reflectors, or coated metal reflectors. The preferred blue light is then reflected (directed) to an optical channel 68 receiving at an input end to channel 68 the emitted blue light. The channel 68 may be an optical fiber, a light pipe or similar light channeling device having reflective wall facing inwards towards the body of the channel 68 to thereby contain and direct the blue light from an input end to an output end of the channel 68. The blue light is directed from an output end of the channel 68 to a focal region, and may then be conveniently concentrated on a region or target area, such as a dental material placed in a cavity formed in a patient's tooth, or similar workpiece or material for processing. The blue light can also be focused with a lens into a fiber optic for delivery to the target, or focused on emergence from the optical channel 68. The lamp envelope 12 and power applicator 22 assembly may be held in the neck of a reflector 62 by two half rings 70 made of an insulating material, such as a machinable ceramic.

The preferred microwave power input to the power applicator 22 is a microwave supply 80 operating in the ISM band centered around 2.45 GHz. There are a variety of such power supplies, including magnetron and solid state devices. It is believed that the power supply 80 is a matter of design choice, and its particular choice should not effect the operation of the lamp assembly 10. Suitable impedance matching devices such as tuning stubs or matching circuits can be used to match the power supply 80 and lamp assembly 10 impedances for optimum power transfer. Also isolation devices, such as circulators, can be interposed between the power supply 80 and the lamp assembly 10 to prevent unwanted microwave reflection into the power supply 80 as the lamp assembly 10 warms up and experiences impedance changes. While the preferred embodiment operates at 2.45 GHz, other frequencies can be used by suitable scaling of the applicator. Other frequencies which can be used are the other ISM bands near 915 MHz. and 5 GHz. Further, operation need not be confined to within the ISM bands, if suitable shielding is used. As an example, a band at 2.65 MHz could be used. This band is currently used for lighting applications in Europe.

The tubular envelope and power applicator were mounted at a precise optical position within a reflector for optimum use of the light generated from the lamp. In addition, the envelope and power applicator assembly should be attached to the reflector to maintain the precise positioning even under rough handling of the system. Precise positioning may proceed as a two step process. The first step is to position the tubular envelope with respect to power applicator using a precise XYZ positioner and an optical signal strength measurement as a feedback. The second step is to secure the tubular envelope and power applicator to the reflector housing once an optimum position is obtained.

Once the tubular envelope is mounted in the coaxial power applicator, the power applicator assembly may be mounted in the reflector. In one example, an 80 millimeter diameter reflector was held in a fixed position while the power applicator was mounted on a conventional XYZ moveable stage positioner. The moveable stage is attached to the power applicator at the coaxial connector, and the envelope and power applicator assembly are aligned as closely as possible to the center of the opening in the rear of the reflector. An aperture mask is centered on the reflector axis and at the focal point of the reflector. Precise positioning of the lamp envelope and power applicator assembly in the reflector is achieved by monitoring the light output through the aperture and adjusting the lamp assembly position for maximum throughput. In the case of a blue weighted spectrum, monitoring of the spectrally integrated blue band intensity with a computer assisted spectrometer proved to be useful.

The reflector and lamp structure should maintain a precise position relative to the reflector even under adverse handling conditions. A displacement of the power applicator with respect to the reflector of several thousands of an inch may be sufficient to destroy the precise focusing established in the lamp-positioning phase. One approach is to place split ring spacers made out of an insulating material, such as a machinable ceramic material like Macor, around the cylindrical power applicator at the central rear opening of the reflector. The spacers provide both a large surface sealing area at the spacer to power applicator interface, as well as at the reflector to spacer interface. In addition, the Macor split rings spacers provide a stable high temperature gap material between the power applicator and reflector. A split ring spacer is necessary here as the dimensions of the power applicator coaxial connector (SMA) and rear sealing area of the reflector preclude using a donut shape.

Sealing of the power applicator, reflector and spacers, may be achieved with a high temperature ceramic-based bonding material, such as Cerastil C3. The bonding material is mixed in a ratio of 5 parts Cerastil C3 to one part water. Once completely stirred, a coating of the bonding material is placed on the sealing area of the power applicator and on the reflector. The two Macor split ring spacers are positioned and a fillet of the bonding material (Cerastil C3) is applied over the ring spacers. The lamp envelope and power applicator assembly is then brought into position, and the bonding material is allowed to dry. The lamp can be run after sufficient time is allowed for drying and setting of the bonding material (For Cerastil C3, this is approximately one-hour at room temperature.). Other refractory cements are available, such as Saureisen or one of Contronics high temperature cements, and could be used.

Figure 6:
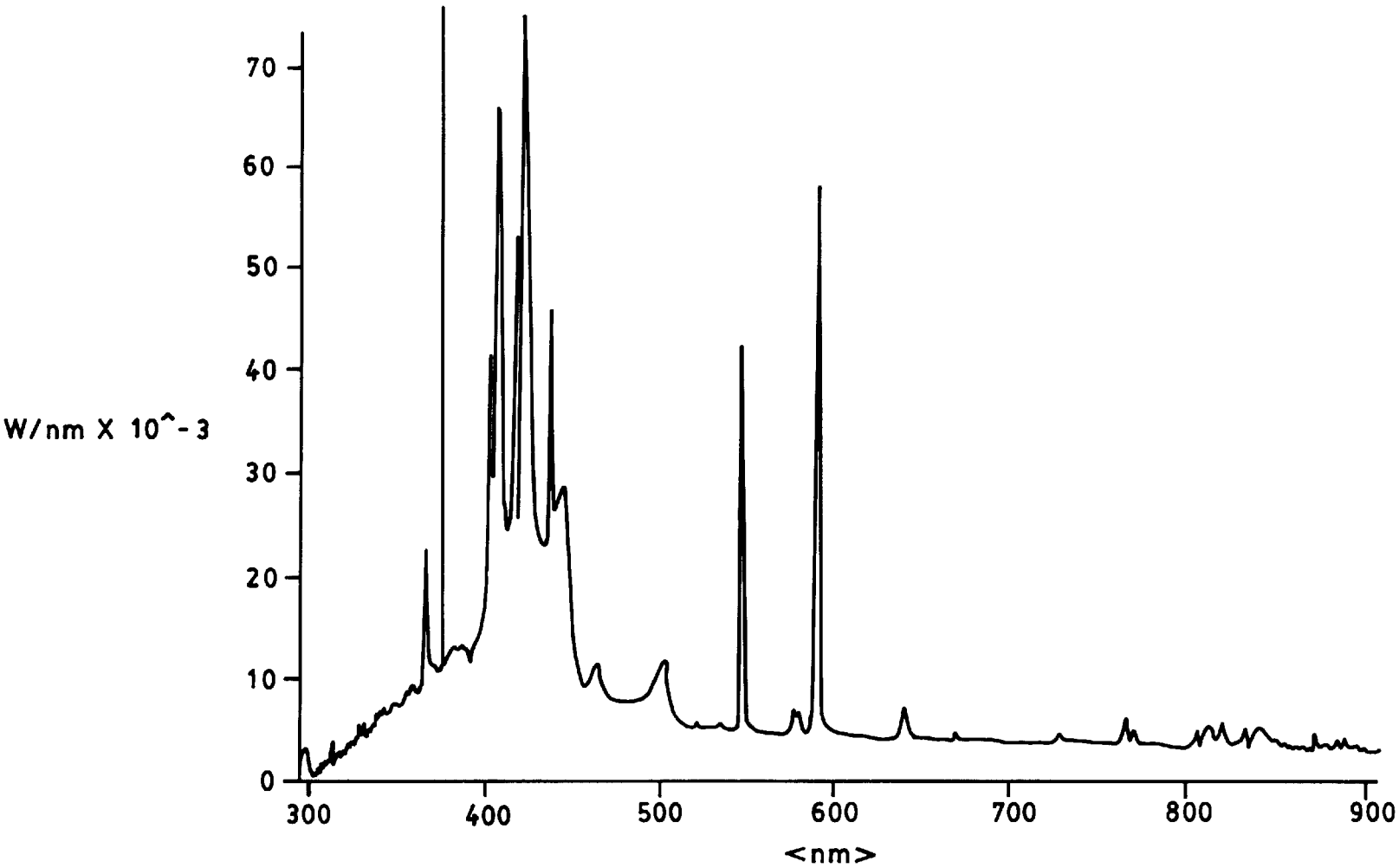
FIG. 6 shows a chart of the spectral output of an EHID lamp containing gallium iodide, and mercury with argon as a buffer gas.

FIG. 6 shows a chart of the spectral output of a lamp containing gallium and mercury with argon as the buffer gas. The X axis shows the wavelength in nanometers. The Y axis shows the output power in watts per nanometer. Review of the chart shows the blue light EHID lamp output to be substantially concentrated in the blue region from 300 to 450 nanometers. Except for two sharp peaks, the lamp output in the remaining regions is nearly constant. The lamp runs at 32 watts of microwave power. The blue light output within the passband 330 to 450 nanometers (blue) is approximately 2.5 watts. The lamp is then about 8.0 percent efficient in converting the input microwave power into blue light. If the power supply efficiency is considered, the system conversion efficiency to blue light is about 3.0 percent. In comparison, a blue line argon ion laser consumes about 1.3 kilowatts of input electrical power to output a coherent blue light beam of only 2 watts. The system efficiency for the blue laser is then about 0.2 percent. The EHID system is then about 15 times as efficient in generating blue light. It is therefore an important advantage of the present invention to increase the efficiency of conversion of electrical power to concentrated blue light.

Figure 7:
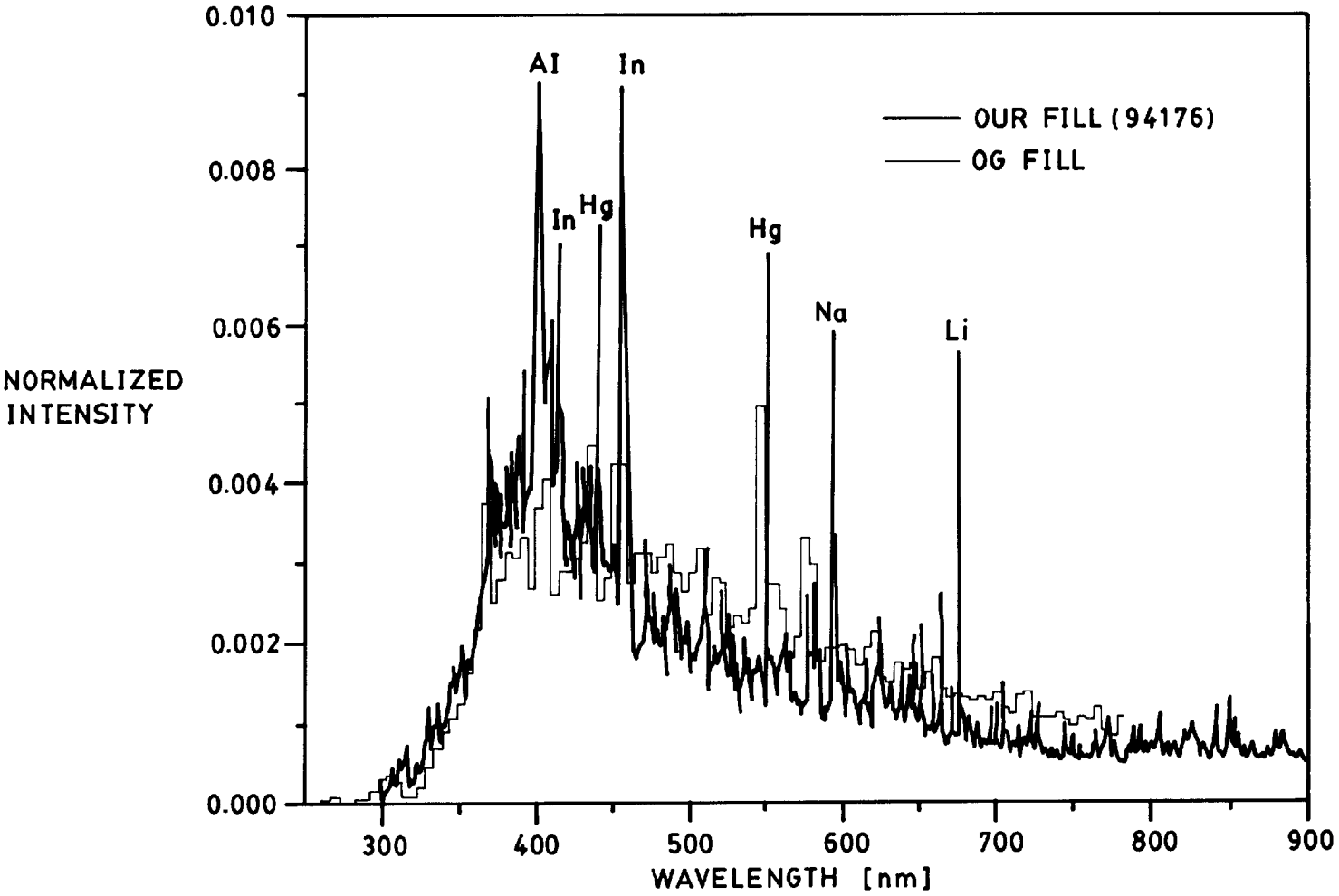
FIG. 7 shows a chart of the spectral output of an EHID lamp containing aluminum iodide, and indium iodide.

FIG. 7 shows a chart of the spectral output of an EHID lamp containing aluminum iodide, and indium iodide. The lamp had a volume of about 0.028 cubic centimeters and an indium fill of about 0.6 milligrams, thereby giving a concentration of about 21.42 milligram per cubic centimeter. No alkali was intentionally included. (There are some sodium and lithium lines due to pollutants in the envelope material. It can be seen that the spectral output is substantially in the blue region, however the spectrum is broadly spread.

Figure 8:
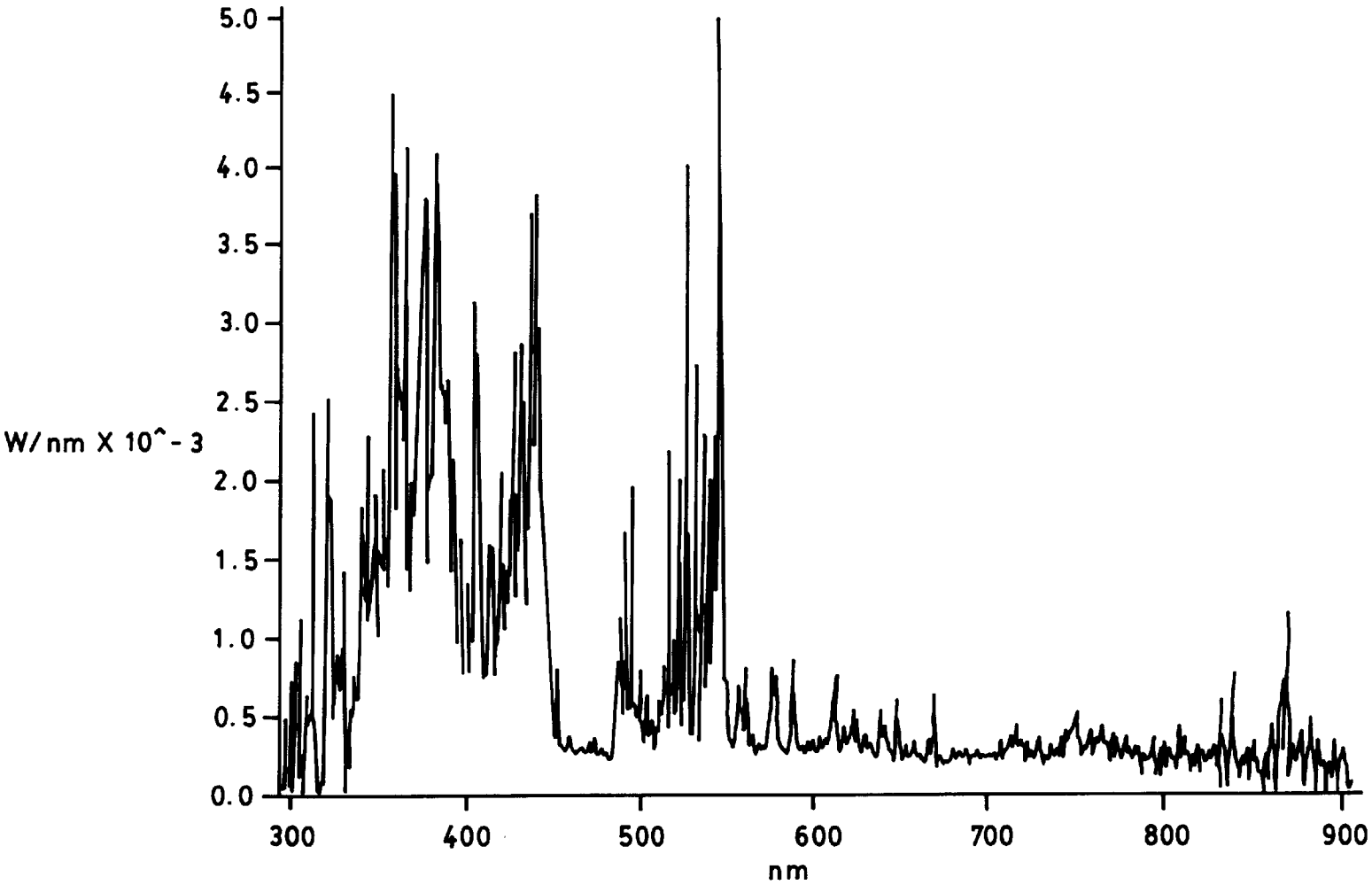
FIG. 8 shows a chart of the spectral output of an EHID lamp containing iron iodide and mercury with argon as a buffer gas.

FIG. 8 shows a chart of the spectral output of an EHID lamp containing iron iodide and mercury with argon as a buffer gas. The lamp had a volume of about 0.017 cubic centimeters and an iron iodide fill of about 0.08 milligrams, thereby giving a concentration of about 4.70 milligrams per cubic centimeter. No alkali is included. It can be seen that the spectral output is substantially in the blue region, with many peaks spreading between about 300 and 450 nanometers. Very little other light is emitted about 550 nanometers.

Figure 9:
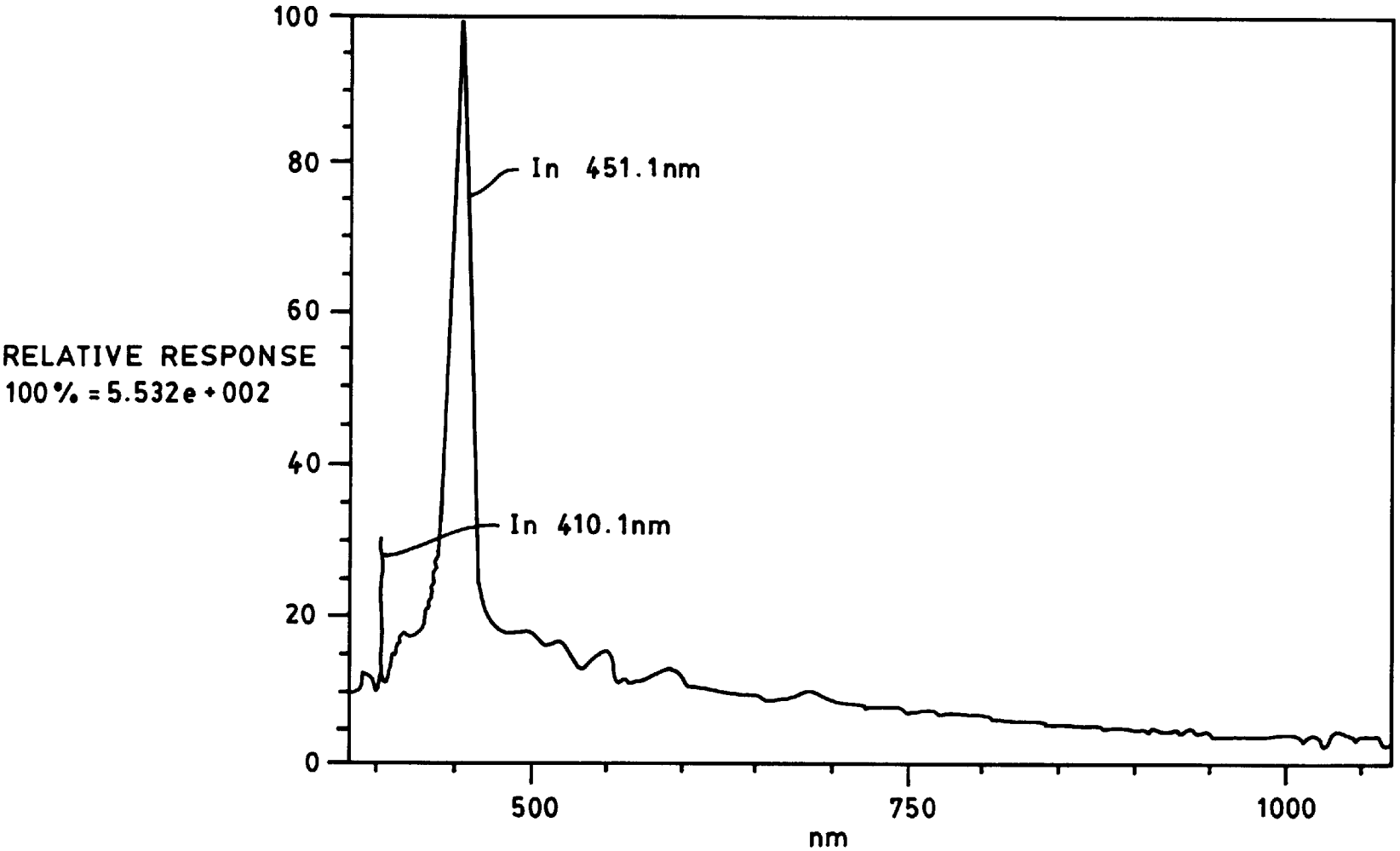
FIG. 9 shows a chart of the spectral output of an EHID lamp containing indium iodide and mercury with argon as a buffer gas.

FIG. 9 shows a chart of the spectral output of an EHID lamp containing indium iodide and mercury with argon as a buffer gas. The lamp had a volume of about 0.028 cubic centimeters and an indium iodide fill of about 0.6 milligrams, thereby giving a concentration of about 21.42 milligram per cubic centimeter. No alkali is included. It can be seen that the spectral output is substantially in the blue region, with a high peak centered on 451.1 nanometers.

Figure 10:
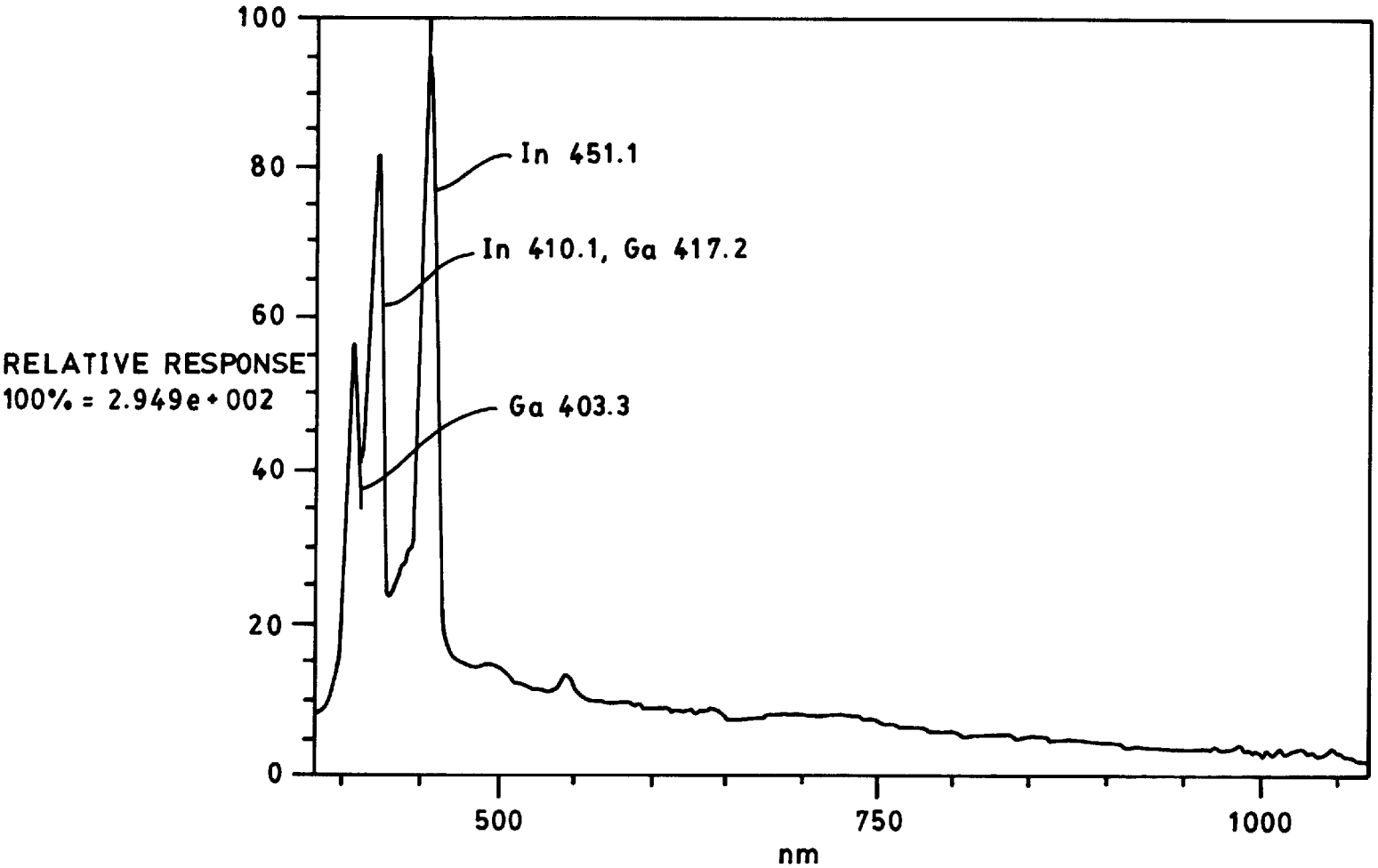
FIG. 10 shows a chart of the spectral output of an EHID lamp containing indium iodide, gallium iodide and mercury with argon as a buffer gas.

FIG. 10 shows a chart of the spectral output of an EHID lamp containing indium iodide, gallium iodide and mercury with argon as a buffer gas. The lamp had a volume of about 0.017 cubic centimeters and an indium fill of about 0.48 milligrams, and of about 0.48 milligrams of gallium iodide. This gives concentrations of about 28.23 milligram per cubic centimeter of both indium iodide and gallium iodide. No alkali is included. It can be seen that the spectral output is substantially in the blue region, with high peaks centered on 403.3, 410.1, 417.2 and 451.1 nanometers with relative little light in the remaining regions. It can be seen that the separate components can be combined for a high blue result. The result has a less narrow passband.

In one embodiment, a dose of 0.078 milligrams of gallium iodide and 0.402 milligrams of mercury was used in a lamp with a volume of 0.017 cubic centimeters (4 mm OD, 2 mm ID, 6 mm length, roughly hemispherical ends), and a pressure of 5 torr of argon. The lamp produced 4.51 watts of total luminous power (295 to 905 nanometers), of which 2.35 watts was "blue" light (from 300 to 450 nanometers). In other words, 52.1 percent of the generated light was then in the "blue" region. In comparison a similar sodium scandium EHID lamp produced 0.77 watts of "blue" light out of 2.33 watts total or about 33 percent of the light was in the blue region. The gallium lamp also produced about 93 percent more total light. The gallium lamp then produced about 3.05 times as much blue light (205.0 percent more blue) for the same input power. Reduction of the gallium iodide to a concentration of about 4.65 milligrams of gallium iodide per cubic centimeter of lamp volume appears to significantly increase the blue light efficiency of the lamp.

The blue light EHID lamp capsules can be made from fused vitreous silica (also called quartz), sapphire, or ceramic or any light transmissive envelope which can also withstand heat and internal pressure. Quartz electrodeless lamps of similar size as above were made and lamp filled with gallium iodide in the range of 0.5 to 50 milligrams per cubic centimeter with a preferred dose of 16.5 milligrams per cubic centimeter, and mercury in the range of 2.5 milligrams per cubic centimeter to 300 milligrams per cubic centimeter with a preferred dose being 23.5 milligrams per cubic centimeter. Iodides of aluminum and iron, and indium in the same ranges may also be used. A summary of sixteen lamps recently tested are listed in FIG. 11, Table 1. The lamps were approximately cylindrical in shape with rounded end chambers and an internal diameter in the range of 0.5 to 10 millimeters, and an external diameter in the range of 1 millimeter to 15 millimeters, and an internal length in the range of 2 millimeters to 25 millimeters. The preferred dimensions were an inner diameter of 2 millimeters, an outer diameter of 4 millimeters and an inner length of about 6 millimeters. The volume was about 0.017 cubic centimeters. Seven lamps of gallium iodide, mercury and argon are listed. The gallium iodide lamps were run with five torr of argon. The gallium iodide lamps had concentrations raging from 11.35 to 17.11 mg/cc. Two lamps of aluminum iodide, mercury and argon are listed. The aluminum iodide lamps were run with five torr of argon, and had concentrations from 5.29 to 15.29 mg/cc. Seven lamps of iron iodide, mercury and argon are listed. The iron iodide lamps were run with ten torr of argon, and had concentrations from 4.70 to 10.58. The lamps used to verify the concept were deliberately kept small to couple well to the small reflector. Scaling the lamps for larger total output is expected.

The microwave power source used in these experiments was a traveling wave tube (TWT) made by Amplifier Research with a variable frequency power supply as a driver from Rohde & Schwarz, and a solid state ballast made internally by Osram Sylvania Inc. Other sources such as magnetrons operated at suitable power levels may be used. The preferred operating power is about 30 watts for the preferred lamp dimensions recited above.

In one embodiment, the generated blue light was projected by a dichroic coated reflector (blue selecting), onto an input end of an optical fiber. The fiber guided the blue light to an output end, where the emerging blue light was directed onto a spot. The spot measured about 3 millimeter in diameter. The fiber optic with the resulting small spot of blue light is extremely practical for delivering curative blue light to a remote target. A dental reconstructive lamp using the blue lamp and reflector system can then be made formed to direct a spot of blue light with a useful size, power and frequency to a patient's tooth holding a quantity of a filler material to be cured by the blue light. Because the dichroic coating on the reflector rejects the visible, only blue light was directed into the fiber and delivered to the patient. This is an important advantage of the present invention since a patient is exposed only to the light needed for therapy. The disclosed operating conditions, dimensions, configurations and embodiments are as examples only, and other suitable configurations and relations may be used to implement the invention. It should be understood that the curative materials, such as polymers used in dentistry can be tuned somewhat to be cured preferentially by particular applied spectrums. A narrow passband of the preferred blue emission can then be created in the lamp, while other unwanted spectral elements can be filtered out, with the resulting blue light well focused on the particular target area giving a very high quality curing. The overall system efficiency in producing the result is very high. Similarly other polymer curing process can be accommodated with the present improved lamp, and fills for industrial or other processes.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp system providing a small spot of intense blue light, comprising:

a microwave power applicator for receiving microwave power input and directing microwave power to a lamp;

the lamp, having a light transmissive envelope having an axis extending from a first end of the lamp to a second end of the lamp, and defining an enclosed volume from 0.005 to 1.0 cubic centimeters, a lamp fill positioned in the enclosed volume, with a concentration of from 0.5 to 50 milligrams per cubic centimeter of a metal halide, an inert buffer gas and no alkali atomic species (group IA) positioned in the enclosed volume, the lamp fill being excitable by microwave power to emit a substantial amount of visible blue light;

a microwave power applicator supplying microwave power to the enclosed volume of the lamp;

a reflector surrounding the lamp envelope, the reflector having surface reflecting blue light portions of the output light to a focal point; and an optical channel having one end positioned at the focal point to receive at an input end of the channel the emitted blue light, so that the blue light is directed from the input end of the channel to an output end of the channel for delivery to a target.

2. The system lamp in claim 1, wherein the envelope is positioned in a reflector having surface reflecting blue light portions of the output light and transmitting at least some of the remaining portions of the output light.

3. The system lamp in claim 1, wherein the power applicator includes at least two wires defining a cage power applicator around the lamp envelope.

4. The system lamp in claim 3, wherein the power applicator has six wires.

5. The system lamp in claim 3, wherein the power applicator is formed from a metal sheet, cut and rolled to form a first end ring and a second end ring and wire strips extending between the end rings.

6. The system lamp of claim 1 wherein the lamp includes gallium halide with a concentration of about 4.65 milligrams per cubic centimeter.

7. The system lamp of claim 1, having a concentration of from 11.35 to 17.11 milligrams per cubic centimeter of gallium iodide.

8. The system lamp of claim 1, further having a quantity of aluminum iodide.

9. The system lamp of claim 8 having a concentration of from 5.29 to 15.29 milligrams per cubic centimeter of aluminum iodide.

10. The system lamp of claim 1, having a quantity of iron iodide.

11. The system lamp of claim 10 has an enclosed volume from 0.005 cubic centimeters to 1.0 cubic centimeters and contains a concentration of from 4.70 to 10.58 milligrams per cubic centimeter of iron iodide.

12. The system lamp of claim 1, which is energized by a microwave source operating in the ISM band centered around 2.45 GHz.

13. An electrodeless lamp comprising a light transmissive envelope having an axis extending from a first end of the lamp to a second end of the lamp, and defining an enclosed volume, a lamp fill including aluminum halide with a concentration of from 1.0 milligrams per cubic centimeter to 50.0 milligrams per cubic centimeter and no alkali atomic species (group IA) positioned in the enclosed volume, the lamp fill being excitable by microwave power to emit visible output light, and a microwave power applicator supplying microwave power to the enclosed volume.

14. An electrodeless lamp comprising a light transmissive envelope having an axis extending from a first end of the lamp to a second end of the lamp, and defining an enclosed volume, a lamp fill including indium halide with a concentration of from 1.0 milligrams per cubic centimeter to 50.0 milligrams per cubic centimeter and no alkali atomic species (group IA) positioned in the enclosed volume, the lamp fill being excitable by microwave power to emit visible output light and a microwave power applicator supplying microwave power to the enclosed volume.

15. An electrodeless lamp comprising a light transmissive envelope having an axis extending from a first end of the lamp to a second end of the lamp, and defining an enclosed volume, a lamp fill including iron halide with a concentration of from 1.0 milligrams per cubic centimeter to 50.0 milligrams per cubic centimeter and no alkali atomic species (group IA) positioned in the enclosed volume, the lamp fill being excitable by microwave power to emit visible output light, and a microwave power applicator supplying microwave power to the enclosed volume.

* * * * *